US009687901B2

(12) United States Patent
Yamada et al.

(10) Patent No.: US 9,687,901 B2
(45) Date of Patent: Jun. 27, 2017

(54) METHOD OF HYDROFORMING OF HOLLOW STRUCTURAL COMPONENT

(71) Applicant: HONDA MOTOR CO., LTD., Tokyo (JP)

(72) Inventors: Hajime Yamada, Wako (JP); Eri Nishikata, Wako (JP); Yasuhiro Takada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 312 days.

(21) Appl. No.: 14/487,372

(22) Filed: Sep. 16, 2014

(65) Prior Publication Data

US 2015/0089813 A1 Apr. 2, 2015

(30) Foreign Application Priority Data

Sep. 30, 2013 (JP) ..... 2013-205648

(51) Int. Cl.
*B21D 26/031* (2011.01)
*B21D 26/021* (2011.01)
*B21D 26/059* (2011.01)

(52) U.S. Cl.
CPC ..... *B21D 26/031* (2013.01); *B21D 26/021* (2013.01); *B21D 26/059* (2013.01); *Y10T 29/49616* (2015.01)

(58) Field of Classification Search
CPC ..... F01N 13/18; Y10T 29/49398; Y10T 29/49616; Y10T 29/49622; B21D 26/021; B21D 26/031; B21D 26/033; B21D 26/047; B21D 26/049; B21D 26/059
See application file for complete search history.

(56) References Cited

U.S. PATENT DOCUMENTS 5,448,831 A * 9/1995 Harwood ..... B21D 53/84 29/463
6,065,502 A * 5/2000 Horton ..... B21D 26/033 138/109
7,269,986 B2 * 9/2007 Pfaffmann ..... B21D 26/033 72/342.94

(Continued)

FOREIGN PATENT DOCUMENTS

JP 3654210 B2 6/2005

*Primary Examiner* — David Bryant
*Assistant Examiner* — Lawrence Averick
(74) *Attorney, Agent, or Firm* — Birch, Stewart, Kolasch & Birch, LLP

(57) ABSTRACT

Hydroforming into a hollow structural component by pressing a joined plate member outwardly. A largest width is set to an area of a blank portion of the joined plate member extending to between outer peripheral portions of the recessed spaces from a longest constant portion of an internal space formed by the recessed spaces, the longest constant portion being constant in its inner circumferential length and extending the longest in the internal space. A width of an area of the blank portion extending to between the outer peripheral portions from a portion shorter than the longest constant portion is set such that the smaller the length of the portion which is shorter than the longest constant portion is compared to the longest constant portion. The smaller the width of the area extending from the shorter portion is compared to the width of the area extending from the longest constant portion.

20 Claims, 8 Drawing Sheets

(56) References Cited

U.S. PATENT DOCUMENTS

| | | | | |
|---|---|---|---|---|
| 7,406,849 | B2 * | 8/2008 | Ueno | B21D 26/021 228/112.1 |
| 2002/0162877 | A1 * | 11/2002 | Dziadosz | B21D 22/00 228/117 |
| 2007/0163319 | A1 * | 7/2007 | Gade | B21D 26/049 72/56 |
| 2008/0268276 | A1 * | 10/2008 | Ueno | B21D 26/021 428/593 |
| 2009/0038428 | A1 * | 2/2009 | Abe | B21D 26/023 74/492 |
| 2012/0204993 | A1 * | 8/2012 | Higai | B21C 37/0803 138/157 |
| 2013/0298629 | A1 * | 11/2013 | Dykstra | B21D 37/16 72/62 |

* cited by examiner

METHOD OF HYDROFORMING OF HOLLOW STRUCTURAL COMPONENT

CROSS-REFERENCE TO RELATED APPLICATIONS

The present application claims priority under 35 USC 119 to Japanese Patent Application No. 2013-205648 filed Sep. 30, 2013 the entire contents of which are hereby incorporated by reference.

BACKGROUND OF THE INVENTION

1. Field of the Invention

The present invention relates to a method of hydroforming of a hollow structural component such as, for example, an outer tube portion of a muffler of a vehicle.

2. Description of Background Art

See, for example, Japanese Patent No. 3654210.

In the method disclosed in Japanese Patent No. 3654210, a joined plate member, formed by superimposing plates on each other and joining their outer peripheral portions together, is placed between a pair of female dies having recessed spaces formed therein respectively and being arranged with open sides of the recessed spaces facing each other. A fluid such as, for example, water is poured into the joined plate member from an inlet opening opened at a predetermined portion of the joined plate member. By the fluid pressure of the fluid, the joined plate member is pressed outwardly. Thereby, the joined plate member is shaped into a hollow structural component having a shape corresponding to the recessed spaces.

In the method according to Japanese Patent No. 3654210, a perimeter portion of the joined plate member, placed between outer peripheral portions of the recessed portions of the pair of female dies (this portion is called a blank portion hereinbelow), is secured by being pressed between the outer peripheral portions of the recessed portions of the pair of female dies.

However, when the blank portion is pressed like this, a frictional force, that acts when the joined plate member, is drawn to the recessed spaces of the female dies by the fluid pressure varies according to the shape of the recessed spaces of the female dies. Thus, the joined plate member might locally experience an excessive tension force, making the plate thickness of the hollow structural component uneven.

SUMMARY AND OBJECTS OF THE INVENTION

Thus, according to an embodiment of the present invention a method of hydroforming a hollow structural component is provided that is capable of favorable shaping a hollow structural component having an even plate thickness.

According to an embodiment of the present invention, a method of hydroforming a hollow structural component comprises placing a joined plate member (12), made by superimposing stainless steel members on each other and joining outer peripheral portions thereof together, between a pair of female dies (10, 11) which have recessed spaces (10A, 11A) formed therein, respectively, and are arranged with open sides of the recessed spaces (10A, 11A) facing each other and supplying a fluid pressure into the joined plate member (12) so that the joined plate member (12) is pressed outwardly, to thereby shape the joined plate member (12) into the hollow structural component having a shape corresponding to the recessed spaces (10A, 11A). In the method, a main expansion portion (12X) of the joined plate member (12), formed into the shape corresponding to the recessed spaces (10A, 11A) by being pressed outward by the fluid pressure, is placed inside an internal space (S) formed inwardly of outer peripheral portions (10B, 11B) of the recessed spaces (10A, 11A), and a blank portion (12Y) of the joined plate member (12) located on an outer perimeter side of the main expansion portion (12X) is placed between the outer peripheral portions (10B, 11B) of the recessed spaces (10A, 11A). A width of an area of the blank portion (12Y) extending to between the outer peripheral portions (10B, 11B) of the recessed spaces (10A, 11A) from a longest constant portion (S3) of the internal space (S) which is constant in inner circumferential length and extends the longest in the internal space (S) is set to be the largest, and a width of an area of the blank portion (12Y) extending to between the outer peripheral portions (10B, 11B) of the recessed spaces (10A, 11A) from a portion (S1, S2, S4, S5) shorter than the longest constant portion (S3) is set such that the smaller a length of the portion (S1, S2, S4, S5) which is shorter than the longest constant portion (S3) is compared to the longest constant portion (S3), the smaller the width of the area of the blank portion (12Y) extending from the shorter portion is compared to the width of the area of the blank portion (12Y) extending from the longest constant portion (S3). Clearance (C) between the outer peripheral portions (10B, 11B) of the recessed spaces (10A, 11A) is set to be larger than a thickness (t1) of the blank portion (12Y).

According to an embodiment of the present invention, the width of the blank portion (12Y) is set to vary depending on a frictional force between the joined plate member (12) and the female dies (10, 11).

According to an embodiment of the present invention, a width of the joined plate member (12) is set to be larger than an inner circumferential length of one of the recessed spaces (10A, 11A), and the width of the blank portion (12Y) is set to a dimension that makes an end portion thereof remain between the outer peripheral portions (10B, 11B) of the recessed spaces (10A, 11A) after the hydroforming.

According to an embodiment of the present invention, the internal space (S) of the female dies (10, 11) used has formed therein a plurality of constant portions (S1, S2, S4, S5) including the longest constant portion (S3), one (S2) of the constant portions (S1, S2, S3, S4, S5) being continuous with an adjacent other one (S3) of the constant portions in a bending manner, and a width of an area of the blank portion (12Y) extending to between the outer peripheral portions (10B, 11B) of the recessed spaces (10A, 11A) from, and a vicinity of, a bending point (P1) between the one constant portion (S2) and the other constant portion (S3) is set to be larger on a side where a longer one of the one constant portion (S2) and the other constant portion (S3) is located.

According to an embodiment of the present invention, a width of an area of the blank portion (12Y) extending over the one constant portion (S2) and the other constant portion (S3) is set to gradually decrease from the side where the longer one of the one constant portion (S2) and the other constant portion (S3) is located to a side where a shorter one of them is located, and a width-change start point (P2) at which the blank portion (12Y) starts the gradual decrease is set near an intersection (P3) between an outline (L1) of the blank portion (12Y) which would extend if the blank portion (12Y) did not decrease in width on the side where the longer one of the one constant portion (S2) and the other constant portion (S3) is located and an extended line (L2) of an edge portion of the shorter one of the one constant portion (S2) and the other constant portion (S3).

According to an embodiment of the present invention, the internal space (S) of the female dies (10, 11) used has formed therein a plurality of constant portions (S1, S2, S4, S5) including the longest constant portion (S3), one (S4) of the constant portions (S1, S2, S3, S4, S5) having an adjacent other one (S5) of the constant portions which is continuous therewith in a curving manner, and a width of an area of the blank portion (12Y) extending to between the outer peripheral portions (10B, 11B) of the recessed spaces (10A, 11A) from, and a vicinity of, a curvature change point (P4) between the one constant portion (S4) and the other constant portion (S5) is set to be larger on a side where the one constant portion (S4) or the other constant portion (S5) which has a larger radius of curvature is located.

According to an embodiment of the present invention, a width of an area of the blank portion (12Y) extending over the one constant portion (S4) and the other constant portion (S5) is set to gradually decrease from the side where the one constant portion (S4) or the other constant portion (S5) which has the larger radius of curvature is located to a side where the other one of them which has a smaller radius of curvature is located, and a width-change start point (P5) at which the blank portion (12Y) starts the gradual decrease is set near an intersection (P6) between an outline (L3) of the blank portion (12Y) which would extend if the blank portion (12Y) did not decrease in width on the side where the one constant portion (S4) or the other constant portion (S5) which has the larger radius of curvature is located and a circle of curvature (L4) of the radius of curvature of the one constant portion (S4) or the other constant portion (S5) which has the smaller radius of curvature.

According to an embodiment of the present invention, the width of the blank portion is increased at an area experiencing a small frictional force and is decreased at an area experiencing a large frictional force, the frictional forces being experienced by those areas while the joined plate member is drawn to the recessed spaces of the female dies due to a fluid pressure. In addition, the fluid pressure is supplied into the joined plate member with the blank portion not being pressed by the female dies. Thereby, the joined plate member is supplied to the recessed spaces of the female dies smoothly, while local exertion of a large tension force on the joined plate member is suppressed. Thus, hydroforming of a hollow structural component with an even plate thickness can be favorably performed.

More specifically, since the blank portion is not secured, a portion of the joined plate member that is deformed by the longest constant portion does not change or substantially does not change in its plate thickness before and after the hydroforming. Portions of the joined plate member that are deformed by other portions shorter than the longest constant portion, which other portions are shorter than the longest constant portion typically by being bent, curved, or decreased in diameter from the longest constant portion, have a narrower blank portion so that the frictional force may be suppressed. Thus, a change in the plate thickness before and after the hydroforming is suppressed. The method of the present invention can favorably perform hydroforming of a hollow structural component with an even thickness.

According to an embodiment of the present invention, the width of the blank portion after hydroforming can easily become even. Thus, the adjustment work to be performed after the hydroforming can be reduced.

According to an embodiment of the present invention, detachment in the welded portion of the joined plate member after the hydroforming can be suppressed, no excessive stress exerts on the welded portion, and unintended deformation of the hollow structural component can be suppressed.

According to an embodiment of the present invention, since a longer constant portion experiences a smaller frictional force when the joined plate member is drawn, increasing or decreasing the length of the blank portion extending from the bending point and the vicinity thereof according to the frictional force allows certain and smooth supply of the joined plate member into the recessed spaces of the female dies. Thus, exertion of a large tension force on the joined plate member can be effectively suppressed.

According to an embodiment of the present invention, since the joined plate member can be certainly and smoothly supplied into the recessed spaces of the female dies, exertion of a large tension force on the joined plate member can be effectively suppressed.

According to an embodiment of the present invention, a portion having a larger radius of curvature experiences a smaller frictional force when the joined plate member is drawn, increasing or decreasing the length of the blank portion extending from the curvature change point and the vicinity thereof according to the frictional force allows a certain and smooth supply of the joined plate member into the recessed spaces of the female dies. Thus, exertion of a large tension force on the joined plate member can be effectively suppressed.

According to an embodiment of the present invention, since the joined plate member can be certainly and smoothly supplied into the recessed spaces of the female dies, exertion of a large tension force on the joined plate member can be effectively suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A description is given below of a method of hydroforming of a hollow structural component according to an embodiment of the present invention.

Figure 1:
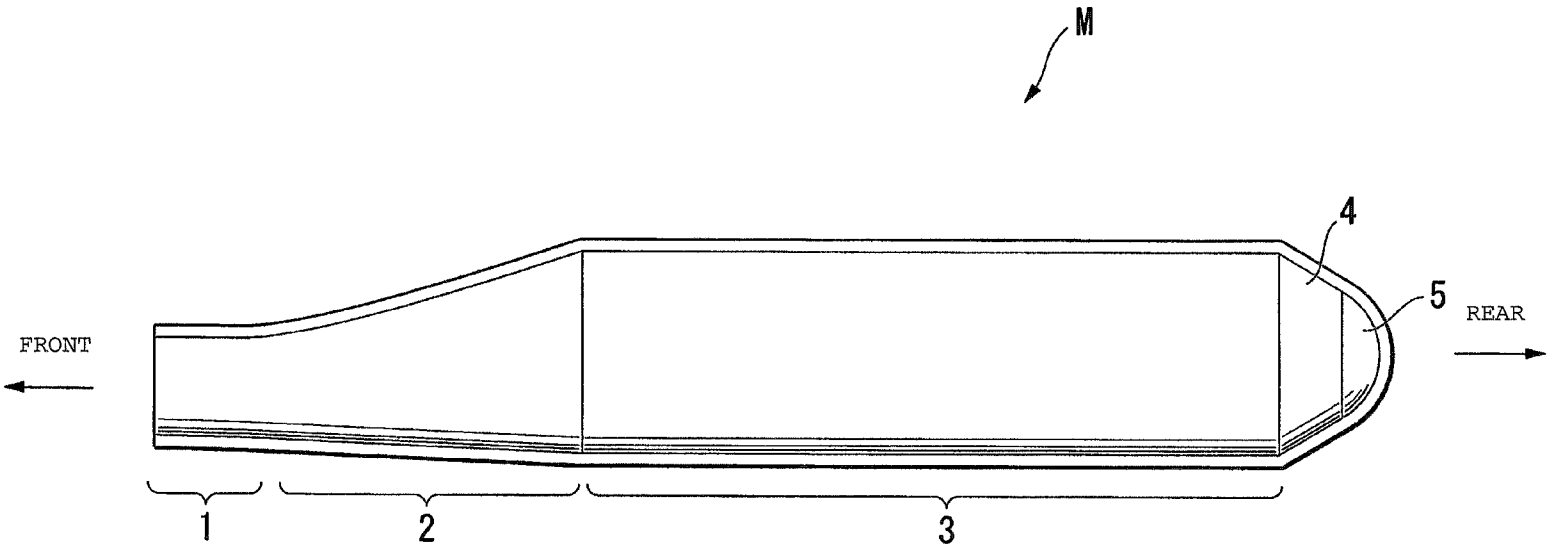
FIG. 1 is a diagram showing an outer tube portion of a muffler being an example of a hollow structural component shaped by a hydroforming method according to the present invention.
Figure 2:
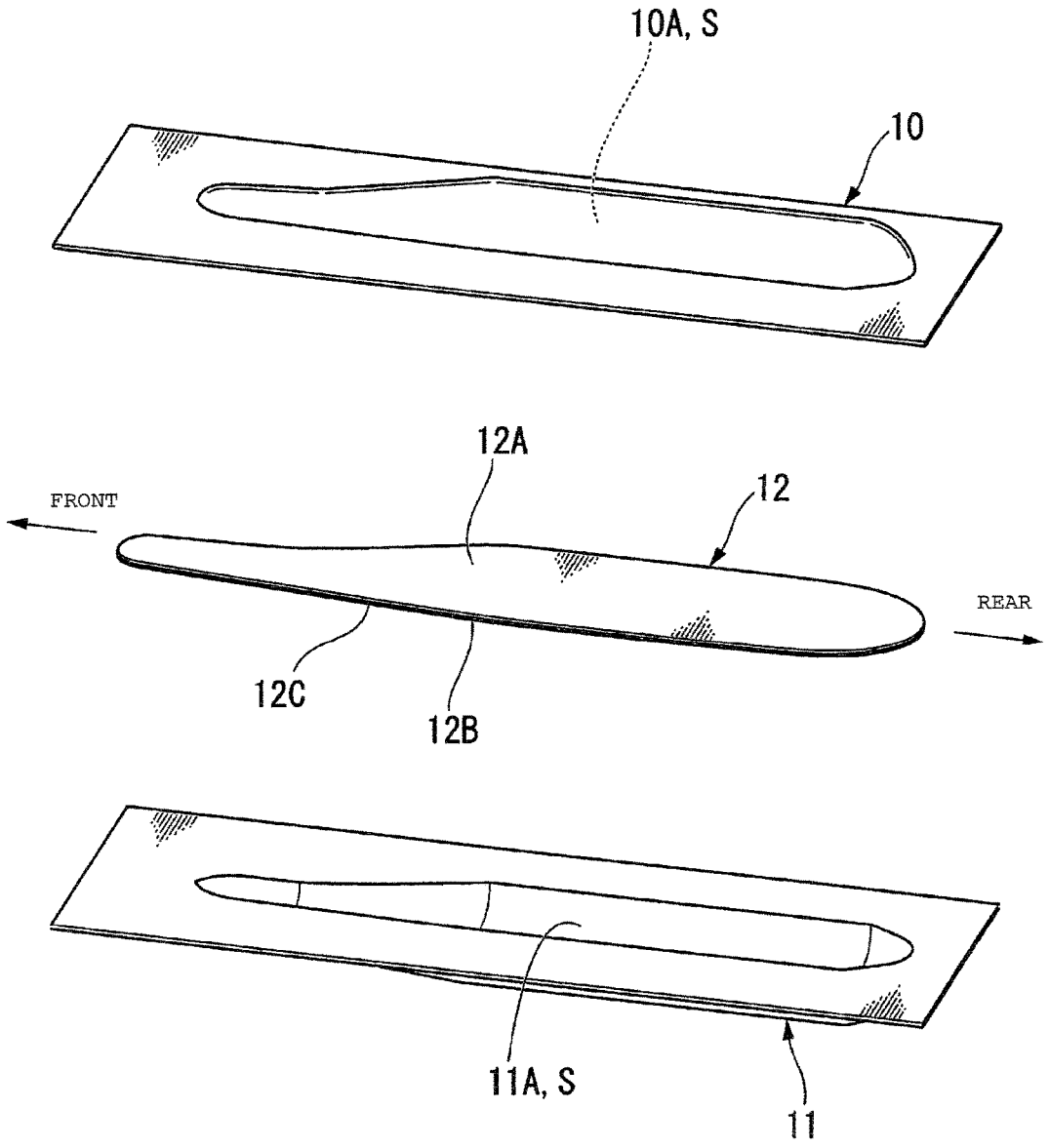
FIG. 2 is a diagram showing an upper female die, a lower female die, and a joined plate member being a material forming the outer tube portion of the muffler, which are used in the hydroforming method according to the present invention.

FIG. 1 shows an outer tube portion M of a muffler being an example of a hollow structural component shaped by a method according to the present invention. The outer tube portion M is a hollow tubular body formed from a metallic material, with one end portion thereof open to be connected to an exhaust pipe (not shown) and the other end portion closed.

As to the orientations of the outer tube portion M, for the sake of convenience, the following description assumes that the open one end portion side of the outer tube portion M is front, and the closed other end portion is rear. Further, for the sake of convenience, FIG. 1 and some other drawings used in the following description have "FRONT" and "REAR" written therein to indicate the orientations of the outer tube portion M.

It should be noted that the orientations such as front and rear explained in the embodiment are defined only for convenience of illustration of the embodiment, and do not necessarily show the actual orientations of the outer tube portion M or of female dies to be described later. The orientations in the embodiment do not limit the present invention.

The outer tube portion M integrally has a first tube portion 1 including a circular section and is open frontward with a second tube portion 2 having a circular section that becomes larger in diameter as it extends rearwardly from a rear end portion of the first tube portion 1. A third tube portion 3 has a circular section that extends rearwardly from a rear end portion of the second tube portion 2. A fourth tube portion 4 has a circular section and becomes smaller in diameter as it extends rearwardly from a rear end portion of the third tube portion 3. A fifth tube portion 5 extends rearwardly from a rear end portion of the fourth tube portion 4 and has a domal shape protruding rearwardly (a spherical-shell shape).

The first tube portion 1 and the third tube portion 3 are each formed in a cylindrical shape whose center axis is along a longitudinal direction. The second tube portion 2 is formed in an eccentric conical shape whose section taken along a direction orthogonal to the longitudinal direction is circular, and whose center axis connecting center points of its circular sections intersects obliquely with the longitudinal direction.

The fourth tube portion 4 is formed in the shape of a truncated cone whose center axis is along the longitudinal direction, and the fifth tube portion 5 is formed in a shape protruding rearwardly along the longitudinal direction.

Note that a section taken along the direction orthogonal to the longitudinal direction in this embodiment is called a vertical section hereinbelow.

Figure 3:
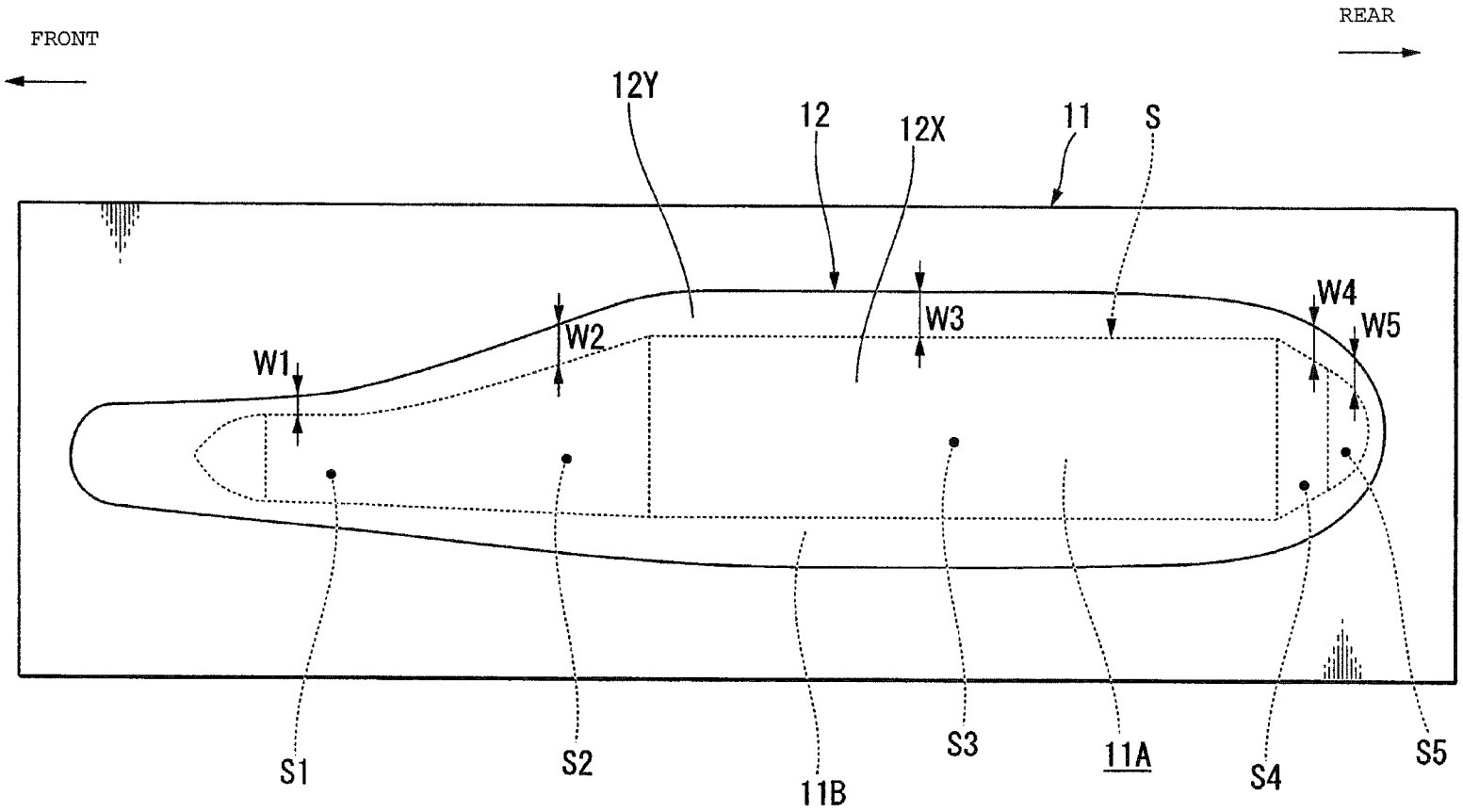
FIG. 3 is a top view of the lower female die and the joined plat material with the joined plate member placed on the lower female die.

As illustrated in FIG. 3, in the hydroforming method according to this embodiment, the outer tube portion M is shaped using an upper female die 10, a lower female die 11, and a joined plate member 12 is a material forming the outer tube portion M.

A recessed space 10A is formed in the upper female die 10 with its longitudinal direction being along the longitudinal direction. The recessed space 10A matches the shape of an upper half of the outer tube portion M, and is arc-shaped in vertical section. A recessed space 11A is formed in the lower female die 11 with its longitudinal direction being along the longitudinal direction. The recessed space 11A matches the shape of a lower half of the outer tube portion M, and is arc-shaped in vertical section.

The upper female die 10 and the lower female die 11 are placed closely to each other with open sides of their recessed spaces 10A, 11A facing each other. The recessed spaces 10A, 11A form an internal space S (cavity) forming the overall outer shape of the outer tube portion M.

The recessed space 10A and the recessed space 11A have shapes such that, in a top view (a view seen in a direction of die matching), they are superimposed on each other and have the same contour.

The joined plate member 12 is formed by superimposing two metal plates 12A, 12B one on the other and joining their outer peripheral portions together by welding. In the drawings, a welded portion 12C is a portion where the metal plates 12A, 12B are joined together. A front end portion of the joined plate member 12 is not welded but is open to be set as an inlet opening for a fluid.

An outline of hydroforming is set forth below. First, the joined plate member 12 is placed between the upper female die 10 and the lower female die 11. More specifically, as shown in FIG. 3, the joined plate member 12 is formed to be larger than the recessed space 10A and the recessed space 11A throughout its perimeter. In this example, the joined plate member 12 is placed on the lower female die 11, and then, the upper female die 10 is placed such that it covers the joined plate member 12 from above.

Then, a fluid such as, e.g., water is poured into the joined plate member 12 from the aforementioned inlet in the joined plate member 12 to thereby supply a fluid pressure to the inside of the joined plate member 12 so that the joined plate member 12 may be pressed outwardly. Thus, the joined plate member 12 is shaped into the outer tube portion M having a shape corresponding to the recessed spaces 10A, 11A.

Figure 4:
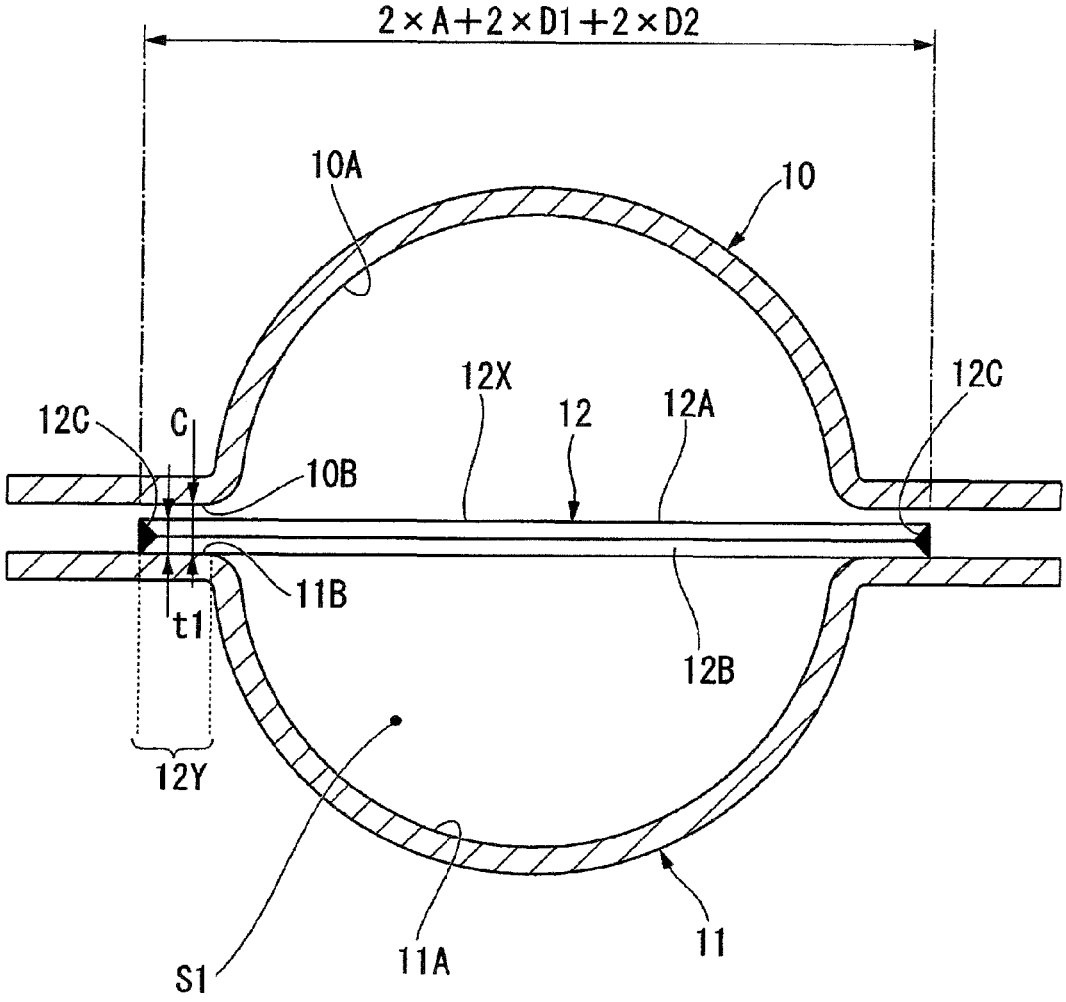
FIG. 4 is a vertical sectional view of the upper female die, the lower female die, and the joined plate member before the hydroforming.

In the hydroforming according to this embodiment, the upper female die 10 and the lower female die 11 are arranged with a space therebetween such that, as shown in FIG. 4, clearance C is created between an outer peripheral portion 10B of the recessed space 10A of the upper female die 10 and an outer peripheral portion 11B of the recessed space 11A of the lower female die 11.

The joined plate member 12 has a main expansion portion 12X which is formed into a shape matching the recessed spaces 10A, 11A (the internal space S) when pressed outward by the fluid pressure, and is placed inside the internal space S which is formed inward of the outer peripheral portions 10B, 11B and a blank portion 12Y which is positioned outwardly of the main expansion portion 12X, and is placed between the outer peripheral portions 10B, 11B.

Note that the main expansion portion 12X is drawn to the recessed spaces 10A, 11A during hydroforming and is thereby formed into a shape matching the recessed spaces 10A, 11A by the hydroforming, but part of the blank portion 12Y is also drawn to the recessed spaces 10A, 11A during the hydroforming.

In the hydroforming according to this embodiment, first of all, the clearance C is set to be larger than a thickness t1 of the blank portion 12Y throughout the perimeter, as shown in FIG. 4. Thereby, the blank portion 12Y is prevented from being pressed by the upper female die 10 and the lower female die 11.

Further, as shown in FIG. 3, the width of the blank portion 12Y extending from the internal space S to between the outer peripheral portions 10B, 11B is set to vary according to the shape of the internal space S.

More specifically, as shown in FIG. 3, in the hydroforming according to this embodiment, a portion of the internal space S for forming the third tube portion 3 of the outer tube portion M is a longest constant portion S3 whose inner circumference is constant in length throughout and which extends the longest. Further, the inner circumference of the longest constant portion S3 is longer in a vertical section than any other portions and is therefore the longest.

A width W3 of an area of the blank 12Y extending from this longest constant portion S3 to between the outer peripheral portions 10B, 11B is set to be the largest in the blank portion 12Y. Note that the width in this example refers to a dimension extending in the direction orthogonal to the longitudinal direction.

The width of an area of the blank portion 12Y extending to between the outer peripheral portions 10B, 11B from each portion of the internal space S which is shorter than the longest constant portion S3 in the longitudinal direction is set such that the smaller the length of the portion shorter than the longest constant portion S3 is compared to the longest constant portion S, the smaller the width of the area of the blank portion 12Y extending from the shorter portion is compared to the width of the area of the blank portion 12Y extending from the longest constant portion S3.

More specifically, in this example, the longest constant portion S3 is the longest in the longitudinal direction, and a front second constant portion S2 for forming the second tube portion 2 of the outer tube portion M is the second longest. Next to the front second constant portion S2, a front first constant portion S1 for forming the first tube portion 1 of the outer tube portion M is the longest. Next to the front first constant portion S1, a rear first constant portion S4 for forming the fourth tube portion 4 of the outer tube portion M is the longest. A rear second constant portion S5 for forming the fifth tube portion 5 of the outer tube portion M is the shortest.

In the hydroforming according to this embodiment, the width of the entire blank portion 12Y is set according to the following relations the width W3 of the area of the blank portion 12Y extending from the longest constant portion S3>a width W2 of an area of the blank portion 12Y extending from the front second constant portion S2>a width W1 of an area of the blank portion 12Y extending from the front first constant portion S1>a width W4 of an area of the blank portion 12Y extending from the rear first constant portion S4>a width W5 of an area of the blank portion 12Y extending from the rear second constant portion S5.

Note that the internal space S is divided into the constant portions S1 to S5 each being a portion whose vertical section has a similar section shape throughout and whose outer surface extends continuously and smoothly.

Each width of the blank portion 12Y is defined in consideration of a frictional force acting when the joined plate member 12 is drawn to the recessed spaces 10A, 11A, such that the width is large at an area experiencing a small frictional force and is small at an area experiencing a large frictional force.

Figure 5:
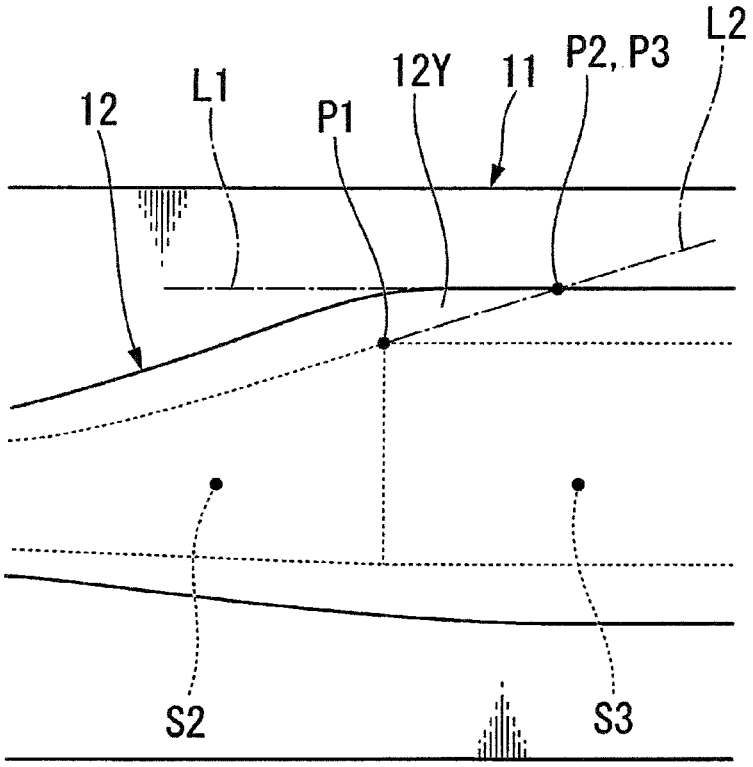
FIG. 5 is an enlargement diagram of FIG. 3, showing an end portion side of a longest constant portion of an internal space formed by the upper female die and the lower female die.

Further, as shown in FIG. 5, in the hydroforming according to this embodiment, the front second constant portion S2 is continuous with and bends from the longest constant portion S3, and the longest constant portion S3 and the front second constant portion S2 are continuous with each other with a bending point P1 therebetween. The width of an area of the blank portion 12Y extending from the bending point P1 and the vicinity thereof is set to be large on the longest constant portion S3 side and to become gradually smaller toward the front second constant portion S2.

More specifically, a width-change start point P2, which is where the blank portion 12Y at an area running across the bending point P1 starts decreasing in width, is set near an intersection P3 between an outline L1 of the blank portion 12Y which would extend if the blank portion 12Y did not decrease in width and an extended line L2 of an edge portion of the front second constant portion S2 extending toward the longest constant portion S3. The area of the blank portion 12Y extending from the longest constant portion S3 gradually decreases starting from the vicinity of the intersection P3 and is smoothly connected to the area of the blank portion 12Y extending from the front second constant portion S2.

Note that the outline L1 is defined with respect to a portion whose vertical section is constant, based on the inner circumference length thereof. The outline L1 calculated is constant for a portion of the constant portion which has a constant inner circumference length, and is obtained by, for example, computation to be described later.

A point other than the bending point P1 can be used for the adjustment in the blank portion 12Y between adjacent constant portions continuous with each other in a bending manner. The setting of the width-change start point as described above is effective only when an extended line of an edge portion of the shorter one of constant portions continuous with each other in a bending manner intersects with an outline of the other constant portion.

Figure 6:
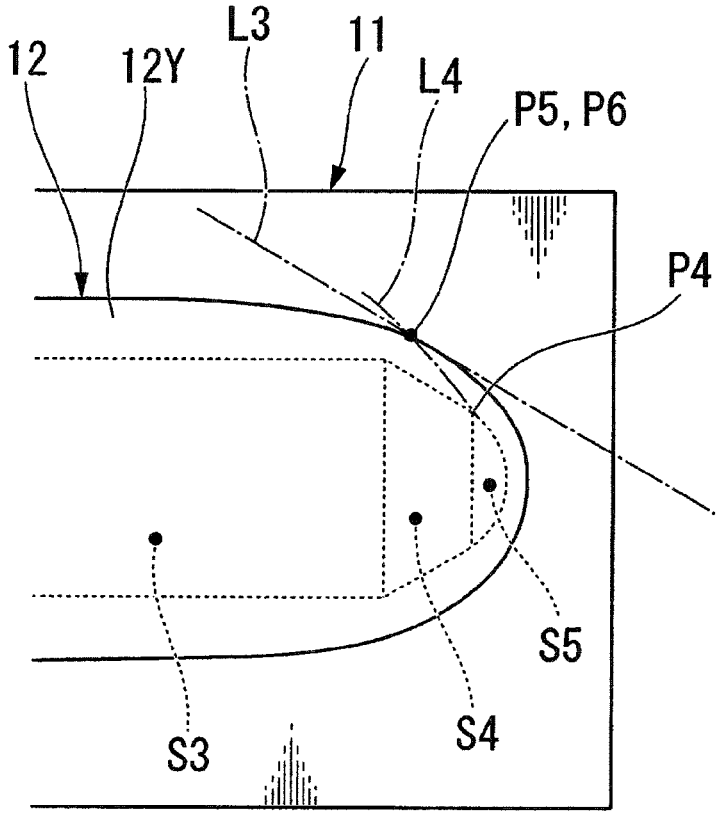
FIG. 6 is an enlargement diagram of FIG. 3, showing the other end portion side of the longest constant portion of the internal space formed by the upper female die and the lower female die.

In the hydroforming according to this embodiment, as shown in FIG. 6, the rear second constant portion S5 extends from the rear first constant portion S4 in a curving manner, and there is a curvature change point P4 between the rear first constant portion S4 and the rear second constant portion S5.

The width of an area of the blank portion 12Y extending to between the outer peripheral portions 10B, 11B from, and the vicinity of, the curvature change point P4 between the rear first constant portion S4 and the rear second constant portion S5 is set to be large on the rear first constant portion S4 side or the rear second constant portion S5 side, whichever has the larger radius of curvature. More specifically, since the rear first constant portion S4 has the shape of a truncated cone in section in this example, the radius of curvature of the edge portion thereof is limitlessly large and is therefore larger than the radius of curvature of the rear second constant portion S5.

For this reason, the width of the area of the blank portion 12Y extending from the curvature change point P4 and the vicinity thereof to between the outer peripheral portions 10B, 11B is larger on the rear first constant portion S4 side.

More specifically, the width of the blank portion 12Y at the area running over the rear first constant portion S4 and the rear second constant portion S5 is set to become gradually smaller from the rear first constant portion S4, which has the larger radius of curvature, toward the rear second constant portion S5.

A width-change start point P5, which is where the blank portion 12Y at an area running over the rear first constant portion S4 and the rear second constant portion S5 starts the gradual decrease, is set near an intersection P6 between an outline L3 of the blank portion 12Y which would extend if the rear first constant portion S4 did not gradually decrease in width and a circle of curvature L4 of an edge portion of the rear second constant portion S5.

When the width of the blank portion 12Y is adjusted in the vicinities of the bending point and the curvature change point as described above, the joined plate member 12 is drawn more smoothly, which suppresses the generation of a large tension force.

Figure 7:
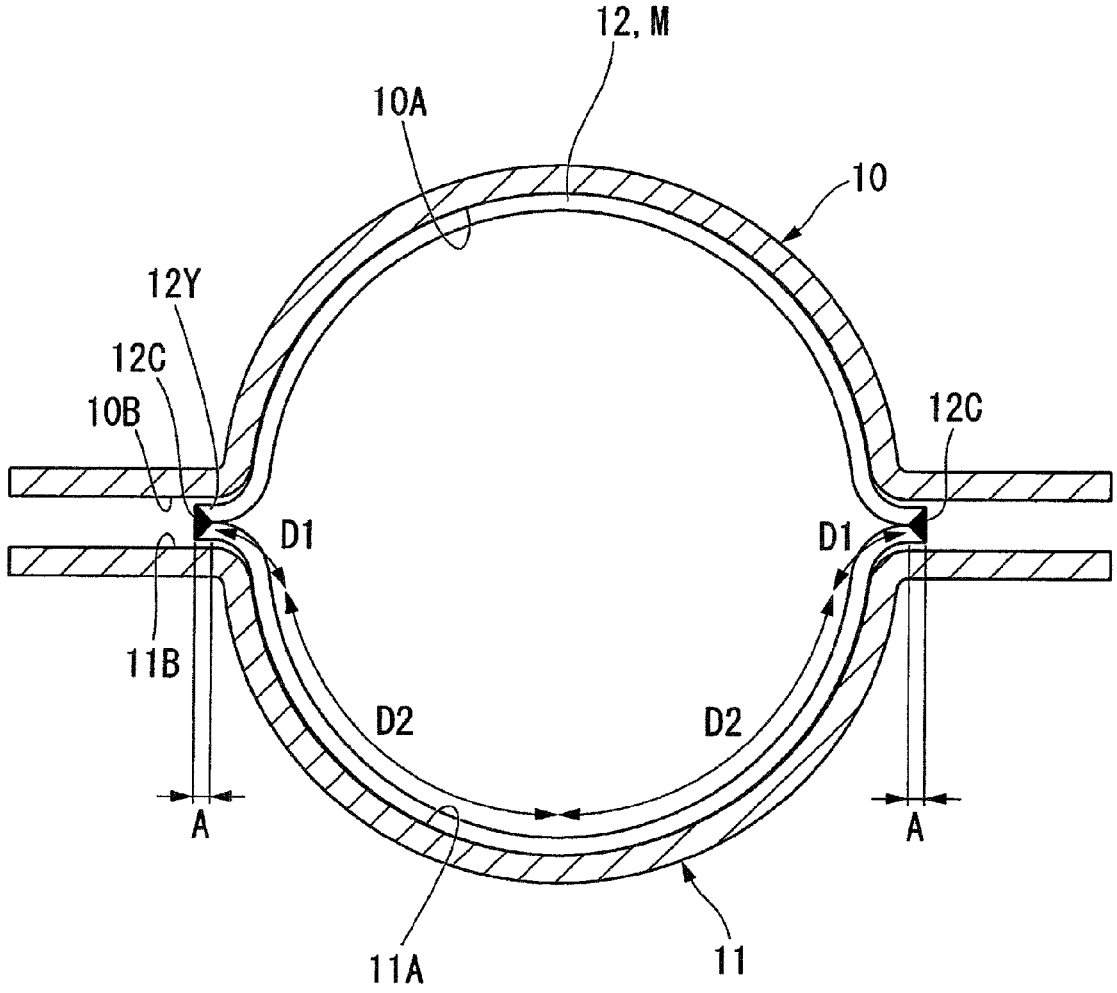
FIG. 7 is a vertical sectional view of the upper female die, the lower female die, and the expanded joined plate member (outer tube portion) after the hydroforming.

In the hydroforming according to this embodiment, as shown in FIG. 7, dimensions of the blank portion 12Y are set such that an end portion of the blank portion 12Y remains between the outer peripheral portions 10B, 11B of the recessed spaces 10A, 11A after the hydroforming.

Such dimensions can be accomplished by making the width of the joined plate member 12 before the hydroforming larger than the inner circumference of a vertical section of the recessed space 10A of the upper female die 10 or the recessed space 11A of the lower female die 11. In this example, the end portion of the blank portion 12Y remains by an amount of a welded length A of the welded portion 12C after the hydroforming. Note that the remaining end portion of the blank portion 12Y is processed and adjusted after the hydroforming.

The dimensions of the blank portion 12Y set for making the end portion of the blank portion 12Y remain by the welded length A of the welded portion 12C are described based on the recessed space 11A of the lower female die 11.

As shown in FIG. 7, in the recessed space 11A of the lower female die 11 over the constant portions S1 to S4, in vertical section, two corner portions at each of which the recessed space 11A and the outer peripheral portion 11B are connected to each other are chamfered in an arc shape, and a portion connected from the corner portions is formed in a semi-circular arc shape.

The radius of curvature for the chamfered arcs of the corner portions is the same for the constant portions S1 to S4.

When the circumference of each of the arc-shaped corner portions is defined as D1 and the circumference of a half of the semi-circular arc shaped portion is defined as D2, the inner circumference of the recessed space 11A can be defined as "2×D1+2×D2."

In order for the end portion of the blank portion 12Y to remain between the outer peripheral portions 10B, 11B after the hydroforming by the amount of the welded length A of the welded portion 12C, as shown in FIG. 4, the width of the joined plate member 12 before the hydroforming is set to be "2×A+2×D1+2×D2."

In order for the end portion of the blank portion 12Y remaining between the outer peripheral portions 10B, 11B after the hydroforming to have more allowance, "2×A" may be 2×(A+allowance length).

Figure 8A:
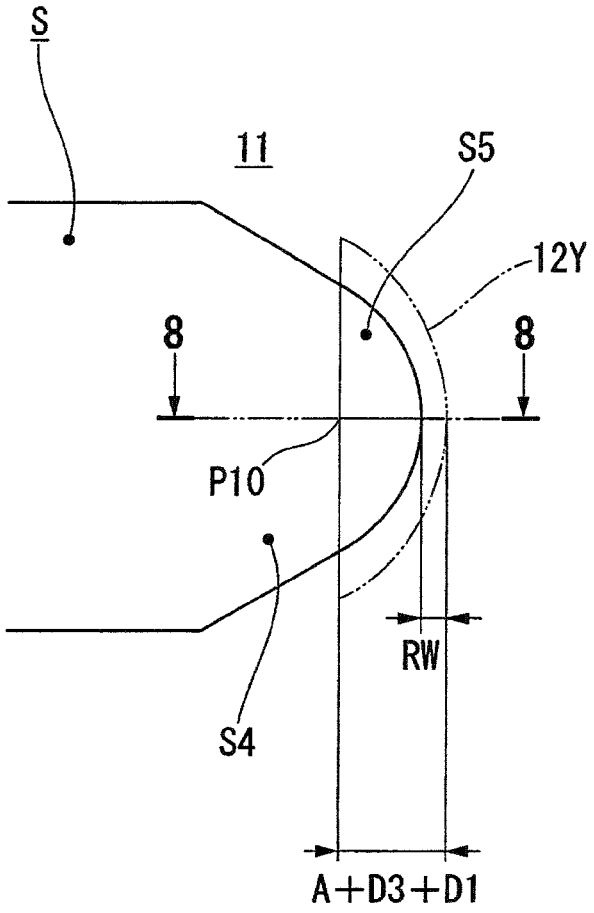
FIGS. 8(A) and 8(B) show diagrams illustrating how a width of a blank portion is set for a portion thereof corresponding to an end portion of the joined plate member, FIG. 8(A) being a schematic top view of a rear end portion of the internal space formed by the upper female die and the lower female die and FIG. 8(B) being a sectional view taken along line 8-8 in FIG. 8(A).
Figure 8B:
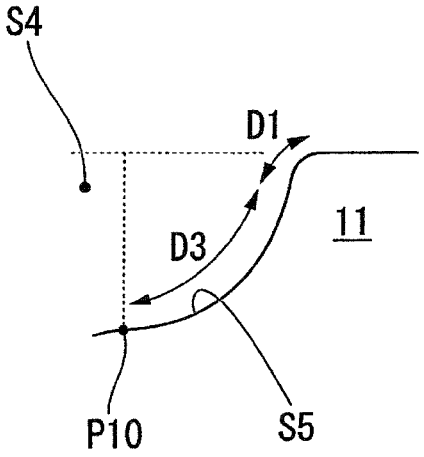

Moreover, in this embodiment, as shown in FIGS. 8(A) and 8(B), the width of an area of the blank portion 12Y extending from the rear second constant portion S5 located at the rear end portion is determined based on an end-portion reference point P10 of the recessed space 11A or the recessed space 10A which point is obtained by projecting the center of a straight line connecting both end portions of the rear second constant portion S5 in a top view, to a position immediately below or immediately above (one inside the recessed space 11A is shown in the drawings).

More specifically, in the rear second constant portion S5, a corner portion at which an area of the recessed space 11A abutting the rear second constant portion S5 is connected to a corresponding area of the outer peripheral portion 11B is chamfered in an arc shape throughout. This arc-shaped corner portion has the same radius of curvature as each of the chamfered corner portions in the constant portions S1 to S4, and its circumference is defined as D1.

When the inner circumference of an inner circumferential surface of the rear second constant portion S5 from the end-portion reference point P10 to the arc-shaped chamfered portion is defined as D3, the inner circumference of the rear second constant portion S5 in a section taken in the longitudinal direction is D1+D3. Then, "A+D1+D3" obtained by adding the welded length A is extended from the end-portion reference point P10 in a top view, and a length of the joined plate member 12 protruding rearwardly of the rear second constant portion S5 is set as a reference length RW. This RW is set as the width of the blank portion 12Y extending rearwardly of the rear second constant portion S5 before the hydroforming.

In this embodiment, an end point of the reference length RW and end points of the blank portion 12Y from the rear first constant portion S4 defined by "2×A+2×D1+2×D2" are connected smoothly in an arc. Thereby, the width of the blank portion 12Y extending from the rear second constant portion S5 is set.

In this embodiment, in addition to the blank portion 12Y given dimensions that make the blank portion 12Y remain by the welded length A after the hydroforming as described above, the width W3 of the area of the blank portion 12Y extending from the longest constant portion S3 to between the outer peripheral portions 10B, 11B is set to be the largest in the blank portion 12Y, and the width of the area of the blank portion 12Y extending to between the outer peripheral portions 10B, 11B from each portion of the internal space S which is shorter than the longest constant portion S3 in the longitudinal direction is set such that the smaller the length of the portion which is shorter than the longest constant portion S3 is compared to the longest constant portion S3, the smaller the width of the area of the blank portion 12Y extending from the shorter portion is compared to the width of the area of the blank portion 12Y extending from the longest constant portion S3.

In the hydroforming according to this embodiment above, the hydroforming is performed with the width of the blank portion 12Y of the joined plate member 12 being adjusted as described above and the blank portion 12Y being prevented from being pressed.

More specifically, a large width is set to the area of the blank portion 12Y that experiences a small frictional force, and a small width is set to the area of the blank portion 12Y that experiences a large frictional force, the frictional forces being experienced by those areas while the joined plate member 12 is drawn to the recessed space 10A of the upper female die 10 and the recessed space 11A of the lower female die 11 due to a fluid pressure. In addition, a fluid pressure is supplied into the joined plate member 12 with the blank portion 12Y being not pressed by the upper female die 10 and the lower female die 11.

Thereby, in the hydroforming according to this embodiment, the joined plate member 12 is supplied smoothly to the recessed space 10A of the upper female die 10 and the recessed space 11A of the lower female die 11. Thus, exertion of a locally large tension force on the joined plate member 12 is suppressed and the joined plate material 12 can be favorably shaped into a hollow structural component with an even thickness.

The shaping method of this embodiment is best used to obtain a hollow structural component having a radius of about 10 to 150 mm, and chamfering of the corner portions of the constant portions in this case is preferably done with a radius of curvature of 4.5 to 5.5 mm, or more preferably 5 mm. In this range, a frictional force exerted while the joined plate member 12 is drawn to the recessed spaces is favorably suppressed, which can therefore achieve non-wasteful shaping where the end portion of the blank portion 12Y remains only by the welded length A of the welded portion 12C as described in the above embodiment.

The embodiment of the present invention has been described above. However, the present invention is not limited to the above embodiment, and can be changed variously without departing from the gist of the present invention. The joined plate member may be made of not only stainless steel, but also other metals or alloys.

For example, the present invention is useful in forming not only the outer tube portion M described in the embodiment, but also various other hollow structural components.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. A method of hydroforming of a hollow structural component, comprising:

placing a joined plate member, made by superimposing stainless steel members on each other and joining outer peripheral portions thereof together, between a pair of female dies which have recessed spaces formed therein surrounded by outer peripheral portions, respectively, and are arranged with open sides of the recessed spaces facing each other and the outer peripheral portions of the recessed spaces facing each other;

positioning a blank portion of the joined plate member on an outer perimeter side of a main expansion portion of the joined plate member between the outer peripheral portions of the recessed spaces:

supplying a fluid pressure into the joined plate member so that the joined plate member is pressed outwardly, to thereby shape the joined plate member into the hollow structural component having a shape corresponding to the recessed spaces;

forming the main expansion portion of the joined plate member into the shape corresponding to the recessed spaces by being pressed outwardly by the fluid pressure and forming inside a longer enlarged area internal space and at least one shorter reduced area internal space formed inwardly of the outer peripheral portions of the recessed spaces, and a width of an area of the blank portion positioned between the outer peripheral portions of the recessed spaces that extends along a length of the longer enlarged area internal space is set to be a predetermined width that is larger relative to a width of an area of the blank portion positioned between the outer peripheral portions of the recessed spaces that extends along a length of the at least one shorter reduced area internal space; and setting a distance between the facing female dies at the outer peripheral portions of the recessed spaces to be larger relative to a thickness of the blank portion.

2. The method of hydroforming of a hollow structural component according to claim 1, wherein the width of the blank portion that extends along the length of the at least one shorter reduced area internal space experiences a larger frictional force relative to the width of the blank portion that extends along the length of the longer enlarged area internal space.

3. The method of hydroforming of a hollow structural component according to claim 2, wherein:

the width of the blank portion is set to a dimension that makes an end portion thereof remain between the outer peripheral portions of the recessed spaces after the hydroforming.

4. The method of hydroforming of a hollow structural component according to claim 2, wherein:

the internal space of the female dies used has formed therein a plurality of internal spaces including the longer enlarged area internal space with each of the internal spaces being continuous with an adjacent other one of the internal spaces in a bending manner: and a width of an area of the blank portion extending to between the outer peripheral portions of the recessed spaces from, and a vicinity of, a bending point between the longer enlarged area internal space and the at least one shorter reduced internal space is set to be larger on the longer enlarged area internal space side.

5. The method of hydroforming of a hollow structural component according to claim 2, wherein:

the internal space of the female dies used has formed therein a plurality of internal spaces including the longer enlarged area internal space and having an adjacent at least one shorter reduced area internal space which is continuous therewith in a curving manner; and a width of an area of the blank portion extending to between the outer peripheral portions of the recessed spaces from, and a vicinity of, a curvature change point between the longer enlarger area internal space and the at least one reduced area internal space and the at least one shorter reduced area internal space is set to be larger on a side where a larger radius of curvature is located.

6. The method of hydroforming of a hollow structural component according to claim 1, wherein:

the width of the blank portion is set to a dimension that makes an end portion thereof remain between the outer peripheral portions of the recessed spaces after the hydroforming.

7. The method of hydroforming of a hollow structural component according to claim 6, wherein:

the internal space of the female dies used has formed therein a plurality of internal spaces including the longer enlarged area internal space with each of the internal spaces being continuous with an adjacent other one of the internal spaces in a bending manner: and a width of an area of the blank portion extending to between the outer peripheral portions of the recessed spaces from, and a vicinity of a bending point between the longer enlarged area internal space and the at least one shorter reduced internal space is set to be larger on the longer enlarged area internal space side.

8. The method of hydroforming of a hollow structural component according to claim 6, wherein:

the internal space of the female dies used has formed therein a plurality of internal spaces including the longer enlarger area internal space and having an adjacent at least one shorter reduced area internal space which is continuous therewith in a curving manner; and a width of an area of the blank portion extending to between the outer peripheral portions of the recessed spaces from, and a vicinity of, a curvature change point between longer enlarged area internal space and the at least one shorter reduced area internal space is set to be larger on a side where a larger radius of curvature is located.

9. The method of hydroforming of a hollow structural component according to claim 1, wherein:

the internal space of the female dies used has formed therein a plurality of internal spaces including the longer enlarged area internal space with each of the internal spaces being continuous with an adjacent other one of the internal spaces in a bending manner; and a width of an area of the blank portion extending to between the outer peripheral portions of the recessed spaces from, and a vicinity of, a bending point between the longer enlarged area internal space and the at least one shorter reduced internal space is set to be larger on the longer enlarged area internal space side.

10. The method of hydroforming of a hollow structural component according to claim 9, wherein:

a width of an area of the blank portion extending over the length of the longer enlarged area internal space is set to gradually decrease from the side where the length of the longer area internal space is located to the side where the at least one shorter reduced area internal space is located; and a width-change start point at which the blank portion starts the gradual decrease is set near an intersection between an outline of the blank portion which would extend if the blank portion did not decrease in width on the side where the length of the longer area internal space is located and an extended line of an edge portion of the at least one shorter area internal space.

11. The method of hydroforming of a hollow structural component according to claim 1, wherein:

the internal space of the female dies used has formed therein a plurality of internal spaces including the longer enlarged area internal space and having an adjacent at least one shorter reduced area internal space which is continuous therewith in a curving manner; and a width of an area of the blank portion extending to between the outer peripheral portions of the recessed spaces from, and a vicinity of, a curvature change point between the longer enlarged area internal space and the at least one shorter reduced area internal space is set to be larger on a side where a larger radius of curvature is located.

12. The method of hydroforming of a hollow structural component according to claim 11, wherein:

a width of an area of the blank portion extending over the longer enlarged area internal space and the at least one shorter area reduced area internal space is set to gradually decrease from the side where the longer enlarged area internal space which has the larger radius of curvature is located to a side where the at least one shorter area reduced area internal space has a smaller radius of curvature is located; and a width-change start point at which the blank portion starts the gradual decrease is set near an intersection between an outline of the blank portion which would extend if the blank portion did not decrease in width on the side where the longer enlarged area internal space or the at least one shorter area reduced area internal space which has the larger radius of curvature is located and a circle of curvature of the radius of curvature of the longer enlarged area internal space or the at least one shorter area reduced area internal space which has the smaller radius of curvature.

13. A method of hydroforming of a hollow structural component, comprising:

providing a pair of female dies with recessed spaces formed therein surrounded by outer peripheral portions, respectively, said pair of female dies being arranged with open sides of recessed spaces facing each other and outer peripheral portions of the recessed spaces facing each other;

placing a joined plate member with outer peripheral portions thereof joined together, between said pair of female dies;

placing a blank portion of the joined plate member on an outer perimeter side of a main expansion portion of the joined plate member between the outer peripheral portions of the recessed spaces:

closing the pair of female dies;

supplying a fluid pressure into the joined plate member so that the joined plate member is pressed outwardly, to thereby shape the joined plate member into the hollow structural component having a shape corresponding to the recessed spaces;

forming the main expansion portion of the joined plate member into the shape corresponding to the recessed spaces by being pressed outwardly by the fluid pressure and forming inside a longer enlarged area internal space and at least one shorter reduced area internal space formed inwardly of outer peripheral portions of the recessed spaces, a width of an area of the blank portion positioned between the outer peripheral portions of the recessed spaces that extends along a length of the longer enlarged area internal space is set to be a predetermined width that is larger relative to a width of an area of the blank portion positioned between the outer peripheral portions of the recessed spaces that extends along a length of the shorter reduced area internal space; and setting a distance between the facing female dies at the outer peripheral portions of the recessed spaces to be larger relative to a thickness of the blank portion.

14. The method of hydroforming of a hollow structural component according to claim 13, wherein the width of the blank portion that extends along the length of the at least one shorter reduced area internal space experiences a larger frictional force relative to the width of the blank portion that extends long the length of the longer enlarged area internal space.

15. The method of hydroforming of a hollow structural component according to claim 13, wherein:

the width of the blank portion is set to a dimension that makes an end portion thereof remain between the outer peripheral portions of the recessed spaces after the hydroforming.

16. The method of hydroforming of a hollow structural component according to claim 13, wherein:

the internal space of the female dies used has formed therein a plurality of internal spaces including the longer enlarged area internal space with each of the internal spaces being continuous with an adjacent other one of the constant portions internal spaces in a bending manner; and a width of an area of the blank portion extending to between the outer peripheral portions of the recessed spaces from, and a vicinity of, a bending point between the longer enlarged area internal space and the at least one shorter reduced internal space is set to be larger on the longer enlarged area internal space side.

17. The method of hydroforming of a hollow structural component according to claim 14, wherein:

the internal space of the female dies used has formed therein a plurality of internal spaces including the longer enlarged area internal space with each of the internal spaces being continuous with an adjacent other one of the internal spaces in a bending manner; and a width of an area of the blank portion extending to between the outer peripheral portions of the recessed spaces from, and a vicinity of, a bending point between the longer enlarged area internal space and the at least one shorter reduced internal space is set to be larger on the longer enlarged area internal space side.

18. The method of hydroforming of a hollow structural component according to claim 16, wherein:

a width of an area of the blank portion extending over the longer enlarged area internal space and the at least one shorter area reduced area internal space is set to gradually decrease from the side where the longer enlarged area internal space which has the larger radius of curvature is located to a side where the at least one shorter area reduced area internal space has a smaller radius of curvature is located: and a width-change start point at which the blank portion starts the gradual decrease is set near an intersection between an outline of the blank portion which would extend if the blank portion did not decrease in width on the side where the longer enlarged area internal space or the at least one shorter area reduced area internal space which has the larger radius of curvature is located and a circle of curvature of the radius of curvature of the longer enlarged area internal space or the at least one shorter area reduced area internal space which has the smaller radius of curvature.

19. The method of hydroforming of a hollow structural component according to claim 13, wherein:

the internal space of the female dies used has formed therein a plurality of internal spaces including the longer enlarged area internal space and having an adjacent at least one shorter reduced area internal space which is continuous therewith in a curving manner; and a width of an area of the blank portion extending to between the outer peripheral portions of the recessed spaces from, and a vicinity of, a curvature change point between the longer enlarged area internal space and the at least one shorter reduced area internal space is set to be larger on a side where a larger radius of curvature is located.

20. The method of hydroforming of a hollow structural component according to claim 19, wherein:

a width of an area of the blank portion extending over the longer enlarged area internal space and the at least one shorter area reduced area internal space is set to gradually decrease from the side where the longer enlarged area internal space which has the larger radius of curvature is located to a side where the at least one shorter area reduced area internal space has a smaller radius of curvature is located: and a width-change start point at which the blank portion starts the gradual decrease is set near an intersection between an outline of the blank portion which would extend if the blank portion did not decrease in width on the side where the longer enlarged area internal space or the at least one shorter area reduced area internal space which has the larger radius of curvature is located and a circle of curvature of the radius of curvature of the longer enlarged area internal space or the at least one shorter area reduced area internal space which has the smaller radius of curvature.

* * * * *